United States Patent [19]

Pakosh

[11] Patent Number: 4,589,152

[45] Date of Patent: May 20, 1986

[54] FOLD-AWAY BED ASSEMBLY

[75] Inventor: Peter Pakosh, Winnipeg, Canada

[73] Assignee: Kendon Manufacturing Ltd., Winnipeg, Canada

[21] Appl. No.: 529,333

[22] Filed: Sep. 6, 1983

[51] Int. Cl.[4] ..... A47C 13/40

[52] U.S. Cl. ..... 5/164 R; 5/136; 5/159 R

[58] Field of Search ..... 5/166 R, 166 C, 166 B, 5/164 B, 133, 166 E, 159 R, 164 R, 136, 164 D, 162, 163, 315 B, 164 C; 16/289, 78, 1 C

[56] References Cited

U.S. PATENT DOCUMENTS

| | | | |
|---|---|---|---|
| 380,258 | 3/1888 | Herrinton | 5/164 C |
| 403,851 | 5/1889 | Merrill | 5/164 C |
| 439,444 | 10/1890 | Tracy | 5/164 R |
| 876,498 | 1/1908 | Silverson | 5/166 R |
| 1,229,722 | 6/1917 | Cresco | 5/164 R |
| 4,103,373 | 8/1978 | Luedtke et al. | 5/166 R |

FOREIGN PATENT DOCUMENTS

| | | | |
|---|---|---|---|
| 710157 | 8/1931 | France | 5/164 R |
| 1464852 | 2/1977 | United Kingdom | 5/164 R |

*Primary Examiner*—Alexander Grosz
*Assistant Examiner*—Vinh Luong
*Attorney, Agent, or Firm*—Stanley G. Ade

[57] ABSTRACT

Conventionally, fold-away beds include lift mechanisms either pneumatic or coil springs reacting between the rear of the bed frame and the base of the vertical support framework in order to act as counterbalances for raising and lowering the bed. This places considerable stress and strain upon the vertical frame which has to be anchored firmly to the wall or supporting surface and these anchors often become loose due to the strains imposed thereon. The present invention includes a relatively lightweight frame and bed unit pivoted by the rear thereof to adjacent the base of the frame. A pair of lift arms extend upwardly and rearwardly from the bed unit just forwardly of the pivot points and springs extend from the lift arms upwardly and rearwardly to be secured to the vertical frame sides intermediate the ends thereof. The leverage action provided is such that the vertical frame is easily secured to the wall or supporting structure as very little strain is placed thereon as the bed is raised and lowered. Furthermore, the lifting mechanism is simple and requires relatively lightweight components compared to conventional fold-away beds.

12 Claims, 11 Drawing Figures

FOLD-AWAY BED ASSEMBLY

BACKGROUND OF THE INVENTION

This invention relates to new and useful improvements in fold-away beds, particularly beds which fold upwardly to a substantially vertical position against a wall or within a casing or cabinet.

Conventionally, the bed unit is counterbalanced by means of heavy duty springs extending between the rear transverse frame member of the bed unit and the base of the vertical supports. Alternatively, pneumatic assistors may be provided. In either case, due to the relatively poor leverage relationships, such counterbalance means have to be extremely powerful and therefore place considerable strain upon the entire assembly when operated, particularly when the bed is in the lowered position. This means that the frame and/or supporting cabinet has to be extremely rugged and secured very firmly to the wall or other vertical supporting surface in order to prevent inadvertent loosening and displacement therefrom.

SUMMARY OF THE INVENTION

The present invention overcomes disadvantages inherent with conventional constructions by providing lift or counterbalancing mechanisms which are designed with much superior leverage characteristics thus reducing considerably, any stran on the vertical supporting framework or the like.

In accordance with the invention there is provided a fold-away bed assembly comprising in combination a vertical support frame, a bed frame pivoted by adjacent one end thereof to adjacent the base of said vertical support frame and being movable from a vertical stored position to a horizontal bed position and vice-versa, and tension spring assemblies one upon each side thereof operatively extending between the sides of the vertical support frame intermediate the ends thereof and the sides of said bed frame adjacent to but outboard of the pivotal attachment of said bed frame to said support frame.

Another disadvantage of the invention is to provide means to detachably secure the mattress and box spring to the frame to prevent inadvertent displacement thereof when the bed is in the vertical position yet sill permit the bed to be tucked between the mattress and box spring readily and easily.

A yet further advantage of the present invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
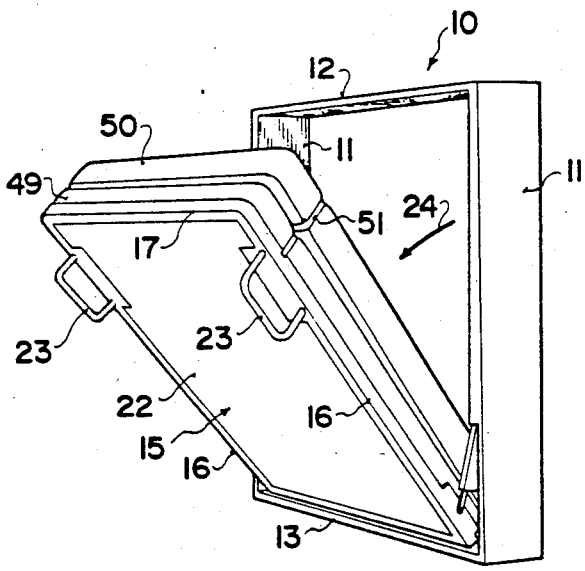
FIG. 1 is an isometric view of the bed within an enclosing cabinet, the bed being partially displaced therefrom.
Figure 2:
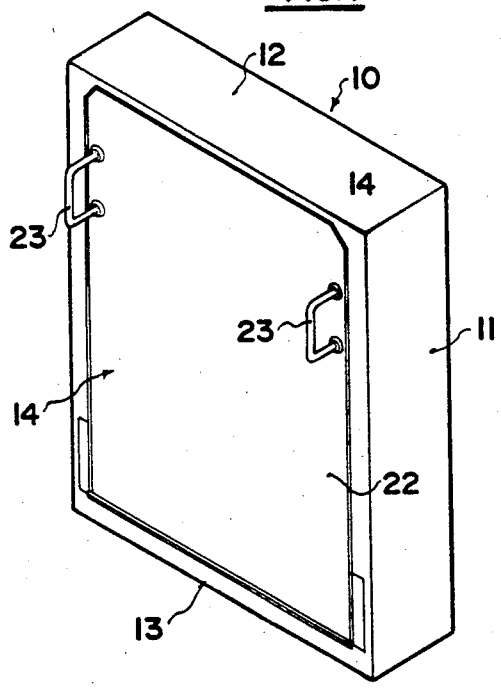
FIG. 2 is a view similar to FIG. 1, but showing the bed in the stored position.
Figure 11:
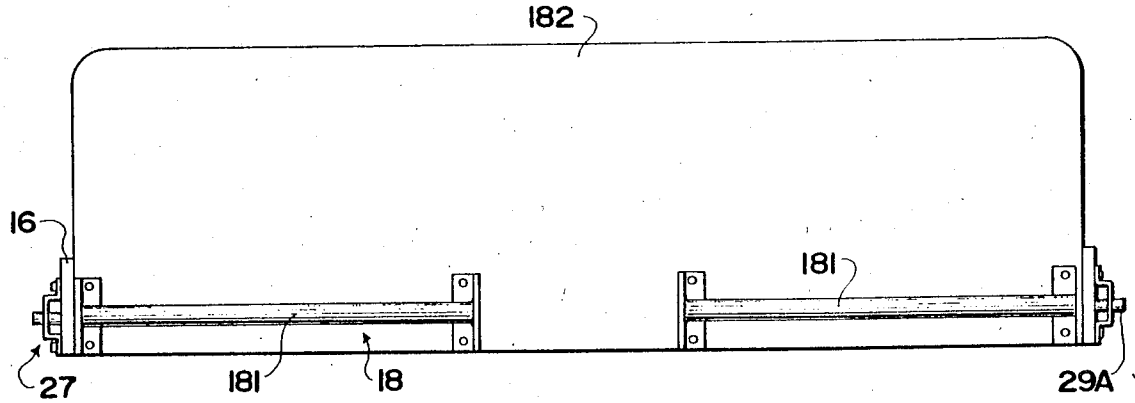
FIG. 11 is a front elevational view of the bed frame of FIG. 1 with the bed frame removed from the vertical frame.

Proceeding therefore to describe the invention in detail, reference should first be made to FIGS. 1 and 2. A substantially rectangular cabinet collectively designated 10 is provided including spaced and parallel vertical sides 11, a transverse upper member 12 and a transverse base member 13. A bed unit is provided collectively designated 14 and consists of a substantially rectangular bed frame collectively designated 15 including a pair of spaced and parallel side rails or member 16, and an outer rail 17 and an inner end rail 18 which may consist of relatively short torsion bars 181 (FIG. 11) to which a headboard 182 may be secured and extend therebetween.

Figure 3:
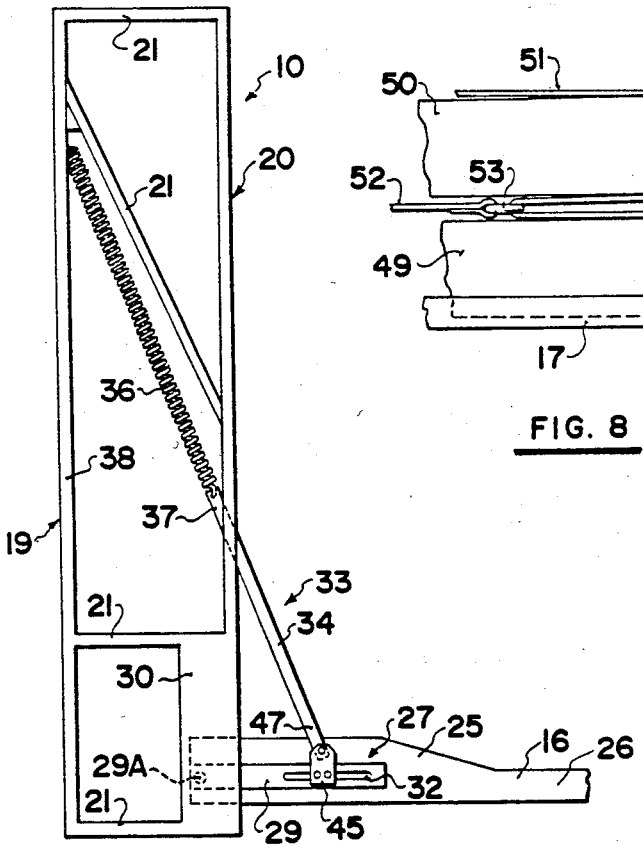
FIG. 3 is a fragmentary side elevation of the supporting frame with the fragmentary portion of the bed frame being in the lowered or horizontal position.
Figure 4:
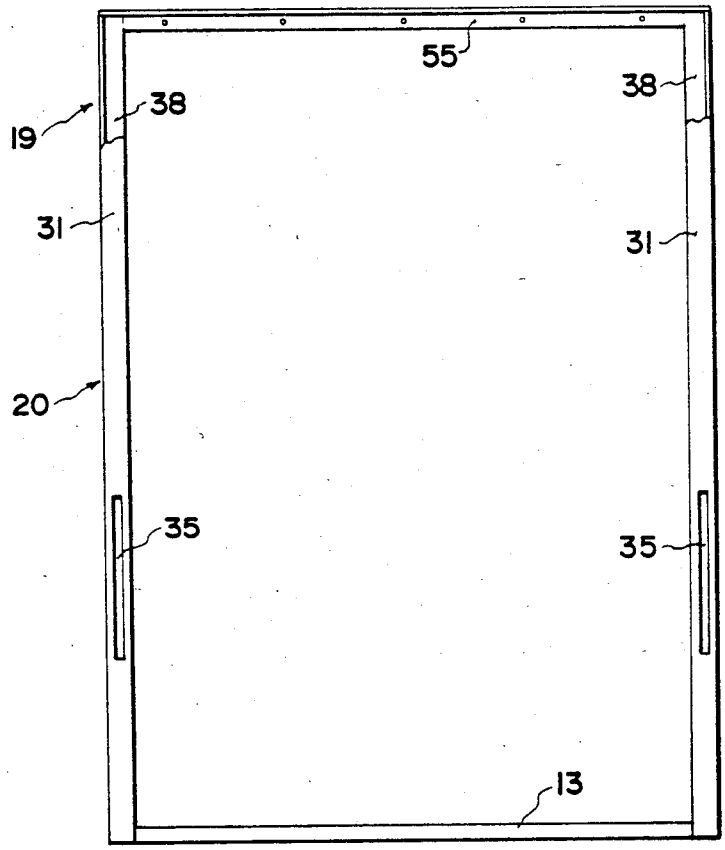
FIG. 4 is a front elevation of the supporting frame per se.

FIGS. 3 and 4 show the skeleton framework 10 which may include a substantially rectangular rear frame 19 and a similar rectangular front frame 20 maintained in spaced and parallel vertical relationship one with the other by means of cross members 21 extending therebetween.

These frames are preferably made of angle iron or the like and are welded together to provide the box configuration which may be covered with plywood or the like as shown in FIGS. 1 and 2.

It will be noted that one of the cross-members 21 extends upwardly and rearwardly in a direction generally parallel to a tension spring 36 described in more detail hereinafter to provide strength for the frame.

Figure 10:
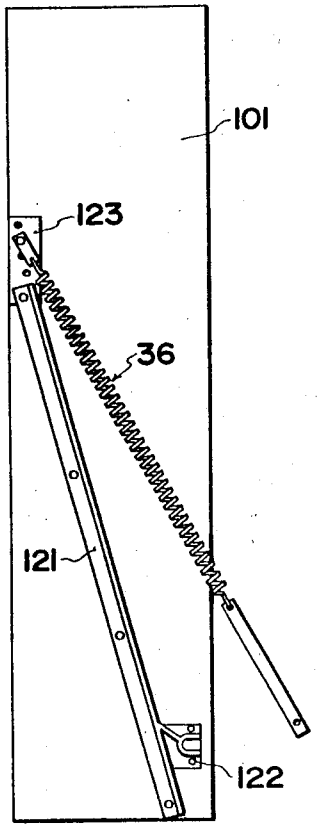
FIG. 10 is a view similar to FIG. 3 showing a modified side of the vertical frame.

In an alternative arrangement shown in FIG. 10, the vertical frame is formed mainly from wood panels 101 forming sides and top with the only supporting metal part comprising side strengthening members 121 similar to the members 21 which extend rearwardly and upwardly from a pivot support 122 for the bed frame to an adjustable support 123 for the tension spring 36. In this case therefore the support 121 supports both the spring 36 and the pivot 122 and extends generally parallel to the tension spring.

It will be noted that the underside 22 of the bed frame may be covered with plywood or the like to form a finished surface as clearly shown in FIG. 2 with handles 23 being secured thereto which enable the bed to be moved downwardly in the direction of arrow 24 to the horizontal position whereupon the handles act as legs supporting the base of the bed a distance spaced from the horizontal supporting surface.

Figure 6:
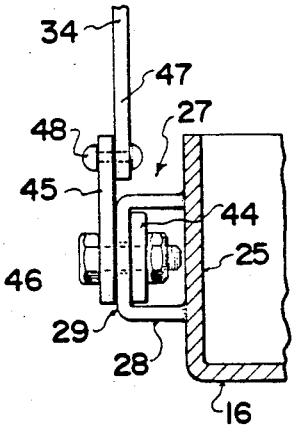
FIG. 6 is an end elevation of FIG. 5 taken from the right-hand side thereof.
Figure 5:
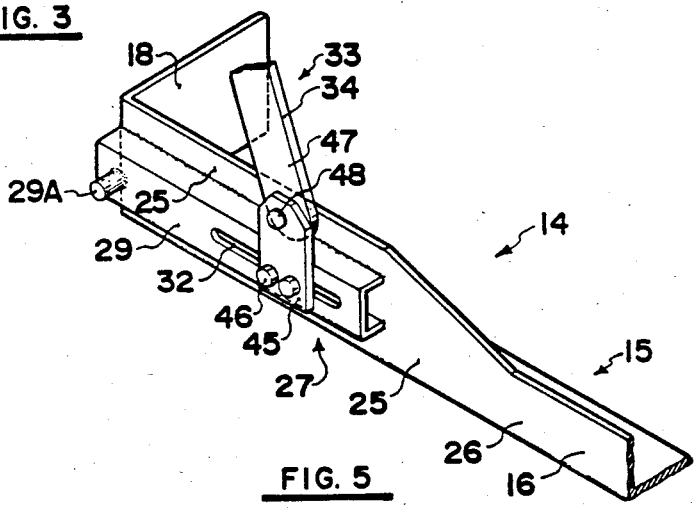
FIG. 5 is a fragmentary enlarged isometric view of the rear side of one of the bed frame members.

The bed unit 14 is pivoted to the front frame 20 as clearly shown in FIGS. 4, 5 and 6. The side members 16 of the bed frame, are formed preferably from angle iron stock and the inner ends 15 are deeper than the remaining length 26. A channel boxing 27 is welded to these portions 25 and extends parallel to the longitudinal axis thereof, said channel boxing including the side flanges 28 and web 29, the channel boxing being welded to the outer surface of the portions 25 by means of the outer edges of the sides 28 so that the web 29 is spaced and parallel from the portions 25 as clearly shown in FIGS. 5 and 6. A heavy duty pivot pin 29A extends through the web adjacent the inner end thereof and through a widening portion 30 of the side members 31 of the front frame 20 spaced upwardly from the lower end of the side frame with the side members 16 being situated inboard of the side members 31.

Closed ended longitudinal slots 32 are formed in the web 29 of the channel outboard of the pivots 29A.

Figure 7:
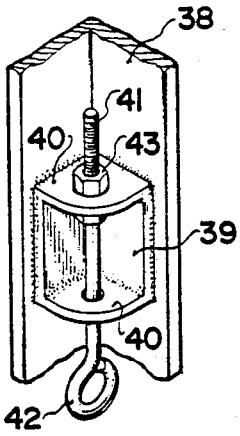
FIG. 7 is a fragmentary isometric view of one of the support frame vertical members showing the spring anchor secured thereto.

Counterbalance tension spring assemblies collectively designated 33 extend between the bed frame 15 and the support frame 10. These each consist of a lift arm 34 pivoted by the lower end thereof to the boxing or channel 27 and extending freely through a vertical slot 35 formed in the web of the side member 31 of the front frame 20. A tension spring 36 is secured by one end thereof to the upper end 37 of the lift arm and extends to be secured to the side members 38 of the rear frame 19 intermediate the ends thereof but towards the upper end. FIG. 7 shows the attachment or anchor of the springs 36.

This anchor takes the form of a bracket 39 welded into the side members 38 and having a pair of spaced and parallel horizontal flanges 40 extending therefrom apertured to receive the threaded portion 41 of an anchor bolt having a hooked lower end 42 to which the spring 36 may be engaged. Lock nuts 43 engage the screw threaded portion 41 above and below the upper plate 40 and by adjusting these nuts, the effective vertical location of hook 42 is controlled, within limits.

The lower ends of the lift arms 34 are secured to the channel 27 for limited adjustment therealong which, together with the adjustment of the anchor bolt 41, provide the necessary adjustment for the effective operation of the springs 36. An anchor block 44 is provided on the inner face of the web and spans the slot 32 and a lift arm plate 45 is provided on the outer side of the web 29 and also spans the slot. Nut and bolt assemblies 46 extend through the lift arm plate 45, through the slot 32 and through the block 44 so that when positioned as desired along the length of slot 32, the nut and bolt assemblies clamp the block 44 and plate 45 in position. The lower end 47 of the lift arm 34 is pivotally attached to plate 45 by means of pivot pin 48.

The bed frame 14 receives a conventional box spring 49 with a mattress 50 overlying same. It will be appreciated that these have to be retained in position particularly when the bed is in the raised or stored position and normally an elastic cord extends clear around the box spring and mattress and is anchored by the ends thereof to the frame. However, this prevents bedding from being tucked between the mattress and box spring at this location so that it hangs freely thus making it somewhat difficult to move the bed to the closed or stored position without this portion of the bedding extending from the cabinet. This problem is overcome in the present invention by providing an elastic cord 51 anchored by one end 51A thereof to one side frame member 16 adjacent the outboard end thereof. It extends transversely over the box spring and mattress to be anchored in a similar manner to the opposite side member.

Figure 8:
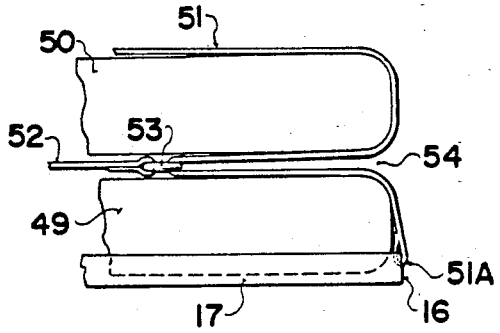
FIG. 8 is a fragmentary end elevation of one side of the bed with the box spring and mattress retainer.

A transverse cord 52 is provided with rings or hooks 53 on either end thereof and these engage the elastic cord 51 at the junction 54 between the box spring and mattress and at the sides thereof. The length of this cord 52 is such that when connected to the cord 51 on either side thereof, the cord at the junction 54 is pulled inwardly as clearly shown in FIG. 8 at points spaced from the side edges of the box spring or mattress. This still retains the box spring and mattress in position, but enables the mattress to be elevated clear of the box spring sufficient to tuck in any bedding so that the mattress, when released, maintains the bedding due to the resilient or elastic cord 51.

In operation, the bed is in the stored position as shown in FIG. 2 and is maintained in the closed position by the tension in springs 36.

When it is desired to lower the bed, the handles 23 are pulled downwardly thus pivoting the bed unit 14 downwardly in the direction of arrow 24 until it assumes the horizontal position with the handles resting upon the floor supporting surface. The tension springs 36 are such that the bed remains in the horizontal position with very little strain being placed upon the support frame 10.

When it is desired to raise the bed, it is moved upwardly in a direction opposite to arrow 24 with the springs 36 counterbalancing the weight of the bed and assisting in the elevating action. Due to the leverage characteristics of the lift arms and springs, the cabinet or frame 10 is easily anchored to the vertical wall or supporting surface by means of a few screws engaging the upper transverse member 55 of the rear frame 19.

Figure 9:
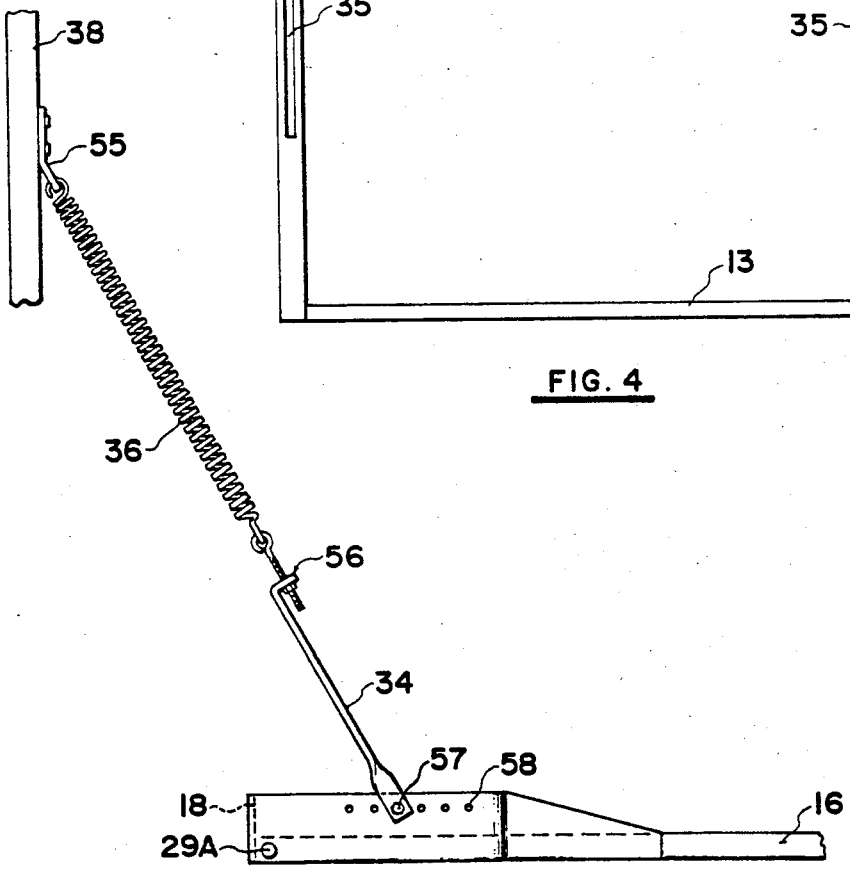
FIG. 9 shows an alternative spring anchor adjustment means.

FIG. 9 shows an alternative anchoring means for the springs 36 in which the upper end is screwed to a bracket 55A and the lower end to a screw threaded adjuster bolt 56 secured to the left arm 34 which is secured by a bolt 57 to side member 16 at any one of several locations indicated by apertures 58.

Since various modifications can be made in my invention as hereinabove described and many apparently widely different embodiments of same made within the spirit and scope of the claims without departing from such spirit and scope, it is intended that all matter contained in the accompanying specification shall be interpreted as illustrative only and not in a limiting sense.

I claim:

1. A fold-away bed assembly comprising in combination a vertical support frame, a bed frame having ends and spaced parallel sides, pivot means arranged adjacent one end of the bed frame so as to couple the bed frame to the vertical support frame at a lower end thereof to provide movement of the bed frame relative to the support frame from a vertical stored position to a horizontal bed position and vice-versa, and tension spring means one upon each side of the bed frame and each operatively extending between said vertical support frame and a respective side of said bed frame, each said tension spring means comprising solely a single tension spring, first coupling means for coupling one end of said spring to said support frame and second coupling means for coupling an opposed end thereof to said respective side of said bed frame at a position thereon adjacent to but spaced from said pivot means and means for adjusting said position of said second coupling means relative to said side in a direction substantially longitudinal to said side.

2. The assembly according to claim 1 which includes a channel member secured to the outer surface of said side of said bed frame adjacent said one end thereof and extending parallel to the longitudinal axis thereof, a pivot extending through the side member of said support frame and the web of said channel, a longitudinally extending, closed ended slot in the web of said channel outboard of said pivot, an anchor block on the inside of said web spanning said slot and movable therealong, a lift arm plate spanning said slot on the outer side of said web and movable therealong and detachable clamp means extending between said block and said lift arm plate and extending through said slot to detachably clamp said block and plate in position along the length of said slot.

3. The assembly according to claim 1 in which said vertical support frame includes a substantially rectangular rear frame and a substantially rectangular front frame, supports extending therebetween maintaining said frames in spaced and parallel relationship with one another, said spring assemblies being secured to the side members of said rear frame.

4. The assembly according to claim 1 in which said bed frame includes a rear member extending between said one ends of said side members and a front member extending between the other ends of said side members, a box spring unit in said bed frame, a mattress overlying said box spring unit and means to detachably hold said mattress and said box spring within said bed frame, said last mentioned means including an elastic cord secured by one end thereof to one side member of said bed frame adjacent the other end thereof and extending transversely over said box spring unit and mattress and being secured by the other end thereof to the other side member of said bed frame and a further cord extending transversely between said box spring unit and said mattress and being secured to said elastic cord at the junction between said box spring unit and said mattress, the length of said further cord being such that the points of securement thereof to said elastic cord pulls said points of securement inwardly between said box spring unit and said mattress to locations spaced inwardly from the sides of said box spring unit and said mattress whereby said box spring unit and said mattress may be detachably moved apart against pressure exerted by said elastic cord sufficient to enable bedding to be tucked therebetween.

5. A kit of parts for a fold-away bed assembly of the type comprising a vertical support frame and frame members for forming a bed frame having ends and parallel spaced sides, the kit comprising pivot means arranged for attachment to the bed frame adjacent one end thereof, pivot coupling means for mounting on the vertical support frame adjacent a lower end thereof whereby the bed frame can be moved from a vertical stored position to a horizontal bed position and vice-versa, tension spring means and means for mounting said tension spring means one upon each side of the bed frame so that each extends from the vertical support frame above said pivot means to a respective side of said bed frame, each said tension spring means comprising solely a single tension spring, first coupling means for coupling one end of said spring to said support frame and second coupling means for coupling an opposed end thereof to said respective side of said bed frame at a position thereon adjacent to but spaced from said pivot means and means for adjusting said position of said second coupling means relative to said side in a direction substantially longitudinal to said side.

6. The kit of parts according to claim 5 which includes a channel member secured to the outer surface of said side of said bed frame adjacent said one end thereof and extending parallel to the longitudinal axis thereof, a pivot extending through the side member of said support frame and the web of said channel, a longitudinally extending, closed ended slot in the web of said channel outboard of said pivot, an anchor block on the inside of said web spanning said slot and movable therealong, a lift arm plate spanning said slot on the outer side of said web and movable therealong and detachable clamp means extending between said block and said lift arm plate and extending through said slot to detachably clamp said block and plate in position along the length of said slot.

7. The kit of parts according to claim 5 in which said pivot coupling means comprises an elongate member and means for mounting said member in a direction extending upwardly and backwardly in a direction generally parallel to that of the tension spring.

8. The kit of parts according to claim 5 including a pair of torsion bars including means for attachment to a head board of said bed frame.

9. A kit of parts according to claim 5 including means for detachably holding a mattress and base on said bed frame, said holding means including an elastic cord having means for securing one end thereof to one side member of said bed frame so as to extend transversely over said base and mattress and means for securing the other end thereof to the other side member of said bed frame and a further cord for extending transversely between said base and said mattress and including means for securing said cord to said elastic cord at the junction between said base and said mattress, the length of said further cord being such that the points of securement thereof to said elastic cord pulls said points of securement inwardly between said base and said mattress to locations spaced inwardly from the sides of said base and said mattress whereby said base and said mattress may be detachably moved apart against pressure exerted by said elastic cord sufficient to enable bedding to be tucked therebetween.

10. A kit of parts for a fold-away bed assembly of the type comprising a vertical support frame, and frame members forming a bed frame having ends and parallel spaced sides, the kit comprising a first pair of members for attachment to respective sides of the said bed frame each said member defining pivot means and first coupling means, a second pair of members for attachment to the vertical support frame, each said second member including an elongate support member having at a lower end thereof a pivot coupling member for cooperating with the pivot means of the first member whereby the bed frame can be moved from a vertical stored position to a horizontal bed position and vice versa, each second member further including second coupling means at an upper end thereof, the first and second coupling means being arranged to receive respective ends of a single tension spring which provides the sole spring connection between the vertical frame and the bed frame, the first coupling means being arranged to connect said tension spring to said bed frame at a position thereon adjacent but spaced from said pivot means and including means for adjusting said position relative to said side of said bed frame in a direction substantially longitudinal to said side and said second coupling means including means for adjusting a position of connection between said tension spring and said vertical frame in a direction substantially longitudinal of said tension spring.

11. The kit of parts according to claim 10 including a pair of torsion bars including means for attachment to a head board of said bed frame.

12. The kit of parts according to claim 10 including means for adjusting one end of the tension spring longitudinally thereof relative to said second coupling means.

* * * * *